US005335384A

United States Patent [19]

Foster et al.

[11] Patent Number: 5,335,384

[45] Date of Patent: Aug. 9, 1994

[54] HOSPITAL BED HEAD EXTENDER AND ACCESSORY THERFOR

[75] Inventors: L. Dale Foster; Ryan A. Reeder, both of Brookville, Ind.

[73] Assignee: Hill-Rom Company, Inc., Batesville, Ind.

[21] Appl. No.: 974,143

[22] Filed: Nov. 10, 1992

[51] Int. Cl.[5] ..... A47C 20/00

[52] U.S. Cl. ..... 5/622; 5/658; 5/661; 5/181; 5/928; 4/519; 4/523; 248/289.1

[58] Field of Search ..... 5/621–623, 5/606, 661, 658, 181, 928, 639, 640, 643, 600; 4/519–523; 248/282, 289.1, 68.1, 118

[56] References Cited

U.S. PATENT DOCUMENTS

| | | | |
|---|---|---|---|
| 477,449 | 6/1892 | Pirrung | 5/661 |
| 2,258,782 | 10/1941 | McKean | 5/623 |
| 2,972,505 | 2/1961 | Weichgenannt | 5/623 |
| 3,733,620 | 5/1973 | Glintz | 5/515 |
| 3,981,031 | 9/1976 | Schacht | 5/658 |
| 4,768,241 | 9/1988 | Beney | 5/658 |
| 4,881,725 | 11/1989 | Hunter | 5/622 |
| 4,882,797 | 11/1989 | Failor et al. . | |
| 4,968,013 | 11/1990 | Kuck | 5/661 |
| 5,135,210 | 8/1992 | Michelson | 5/658 |

*Primary Examiner*—Flemming Saether
*Attorney, Agent, or Firm*—Wood, Herron & Evans

[57] ABSTRACT

A hospital bed has a frame. A horizontal plate is pivotally mounted on a vertical axis to swing from an inoperative position underlying the frame to an operative position extending from the head end of the bed. A pillow can be placed on the extender so that the patient can be shifted toward the head end of the bed with the patient's head comfortably supported on the pillow which is in turn supported on the extender. A basin is adapted to be used in conjunction with the extender and is a shell having a head receiving cavity with a pedestal projecting upwardly from within the cavity for resting the patient's head thereatop while providing clearance completely around the head so that a care provider can shampoo the patient's head.

8 Claims, 5 Drawing Sheets

HOSPITAL BED HEAD EXTENDER AND ACCESSORY THERFOR

FIELD OF THE INVENTION

This invention relates to a hospital bed and is particularly directed to structure that facilitates, among other things, procedures involving abdominal and femoral x-rays, patient hair washing and air way intubations.

In a hospital bed of the type disclosed in U.S. Pat. Nos. 4,926,457 and 4,985,946, the bed has a rectangular frame. The bed has a patient support mounted on the frame, the patient support usually including a head panel, a seat panel, a thigh panel and a leg panel. The head panel, which underlies the chest of the patient, is made of a radiolucent material. C-arm apparatus is adapted to be positioned adjacent the head panel with an x-ray unit above the patient and a receiving image intensifier receiver mounted below the head panel. U.S. Pat. No. 4,985,946 is directed particularly to that hospital bed structure which enables more complete imaging of the patient's chest cavity transversely across the bed while a cardiologist is undertaking certain procedures such as an angiogram. These procedures are sometimes facilitated by shifting the patient longitudinally with respect to the bed so that the patient's head extends beyond the bed frame. Other procedures also require the patient to be shifted longitudinally with respect to the bed thereby extending the patient's head beyond the bed frame such as abdominal and femoral x-rays, patient hair washing and airway intubations.

It has been an objective of the present invention to provide for increasing the length of the bed so as to provide support for the patient's head when it is necessary to shift the patient longitudinally of the bed, while being able to return the bed to its normal length so that the bed may be transported with the patient in it without difficulties that might be encountered if the bed were substantially longer than a conventional hospital bed.

This objective is attained by providing an extender which is movably mounted on the head end of the bed frame so that it can be shifted from an inoperative position underlying the frame to an operative position extending beyond the frame. Preferably, a U-shaped wire brace is pivoted at its free ends to the edge of the extender so that it can be shifted from a horizontal storage position to an operative vertical position. When the extender has been pulled to its operative position beyond the bed and the wire bracket raised, a pillow can be folded and inserted between the brace and the bed and mattress, thereby providing support for the patient's head.

Another feature of the invention has been to provide for the organization of conductors attached to a patient for monitoring procedures such as blood pressure, EKG, pulse and the like. To this end, a block is mounted on the underside of the extender. The block has recesses into which terminals from the various conductors referred to above can be positioned. The other side of the block has a simple cable with plural conductors terminating in a single plug in which all conductors terminate. The single plug can be plugged into a power column, a monitor or a care cart that carries a monitor.

Still another feature of the invention is the provision of a basin which is adapted to be used in conjunction with a hospital bed head end extender of the type disclosed herein which comprises a shell having a head receiving cavity therein and means on opposed longitudinal ends of the shell for snugly fitting the shell between the pillow brace and a mattress atop the bed. On one end the snug fitting means comprises a recess for receiving the U-shaped wire pillow brace, and on the other end the snugly fitting means comprises an inverted L-shaped lip for fitting against vertical and horizontal surfaces of the mattress. The basin further includes a pedestal projecting upwardly from within the cavity for resting a patient's head thereatop thereby providing a caregiver ample clearance completely about the patient's head so that the caregiver can shampoo the patient's head.

BRIEF DESCRIPTION OF THE DRAWINGS

The several features of the invention will become more readily apparent from the following detailed description taken in conjunction with the accompanying drawings in which.

DETAILED DESCRIPTION OF THE INVENTION

Figure 1:
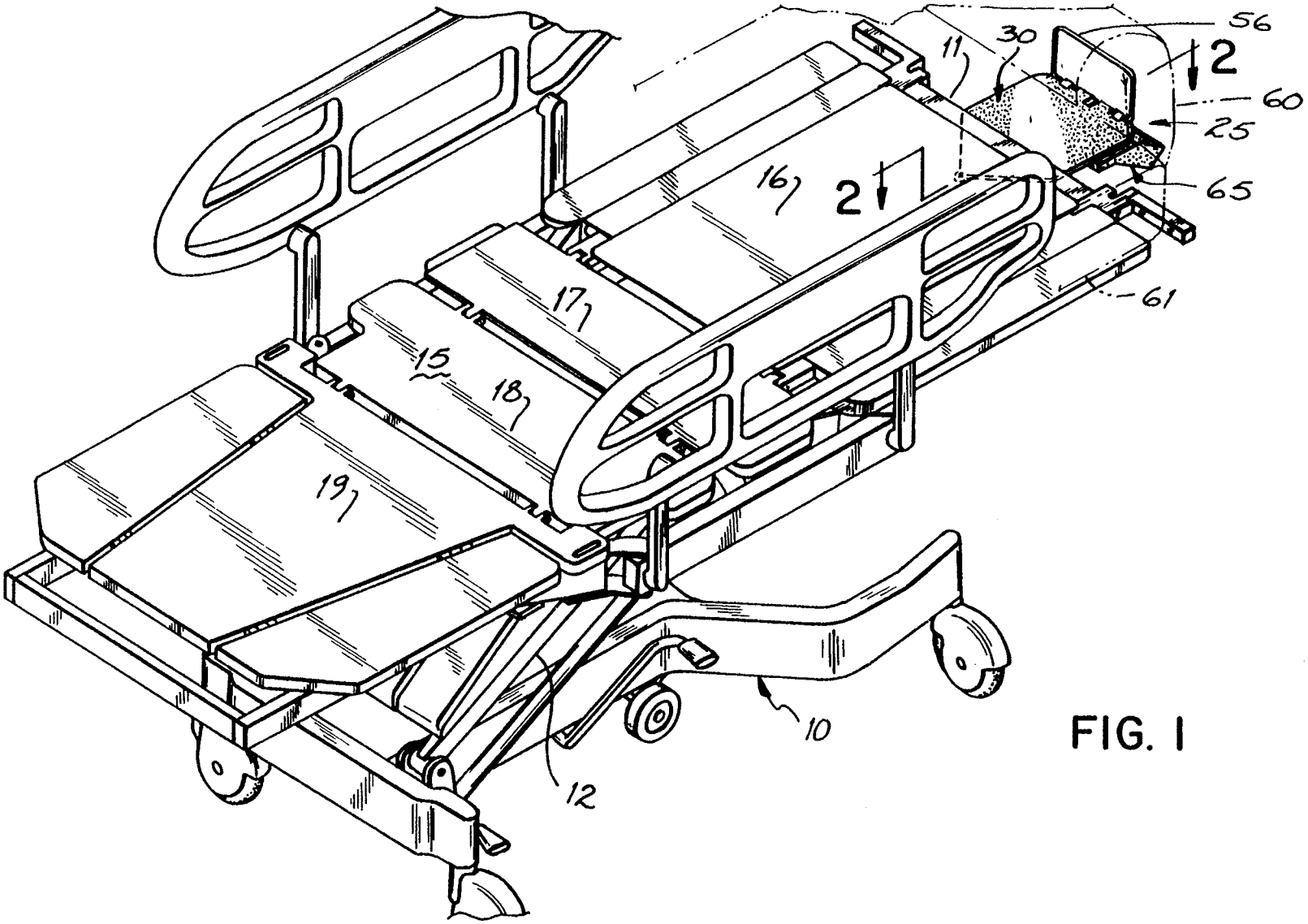
FIG. 1 is a perspective view of a hospital bed having an extender mounted thereon.

Referring to FIG. 1, a hospital bed is shown as having a base 10 and a rectangular frame 11 mounted on the base by an upwardly-angled cantilever beam 12. The frame 11 has a patient support surface 15 consisting of a head panel 16, a seat panel 17, a thigh panel 18 and a leg panel 19. The head panel 16 is pivoted to the seat panel 17, the seat panel 17 being fixed to the frame. A thigh panel 18 is pivoted to the seat panel 17 and the leg panel 19 is pivoted to the thigh panel 18.

The head panel 16 is radiolucent so that when a patient is lying on panel 16, a C-arm unit can be slid into position to x-ray the patient and, for example, to display on a real time monitor the position of the probes in the patient's chest as the cardiologist administers the procedure.

Figure 2:
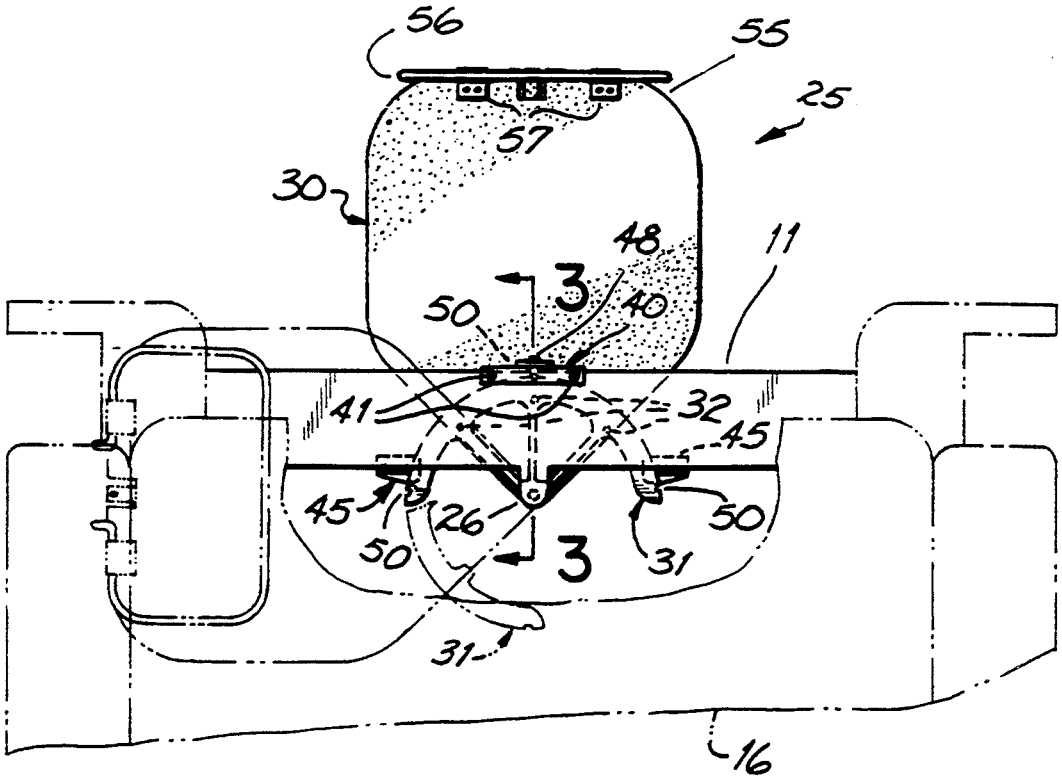
FIG. 2 is a partially broken away plan view of the extender taken in the direction of line 2—2 of FIG. 1.
Figure 3:
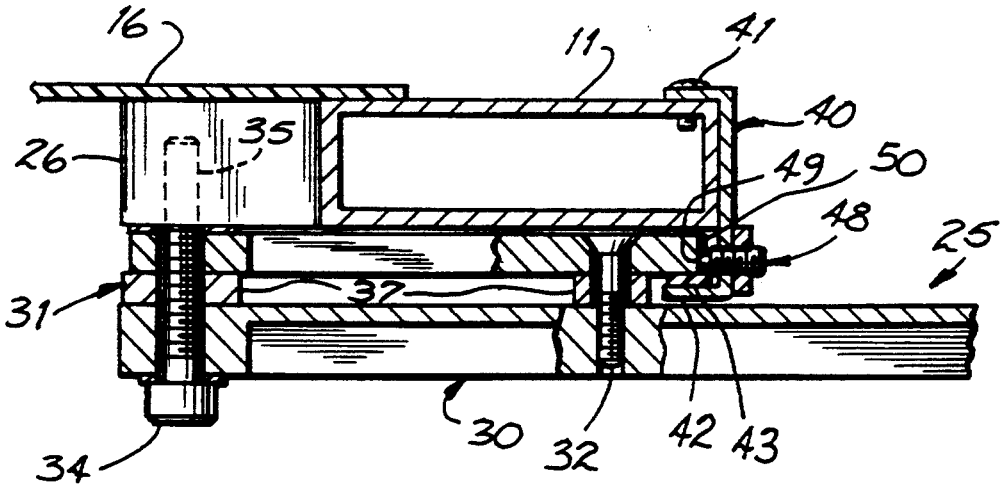
FIG. 3 is a cross-sectional view taken along lines 3—3 of FIG. 2.
Figure 4:
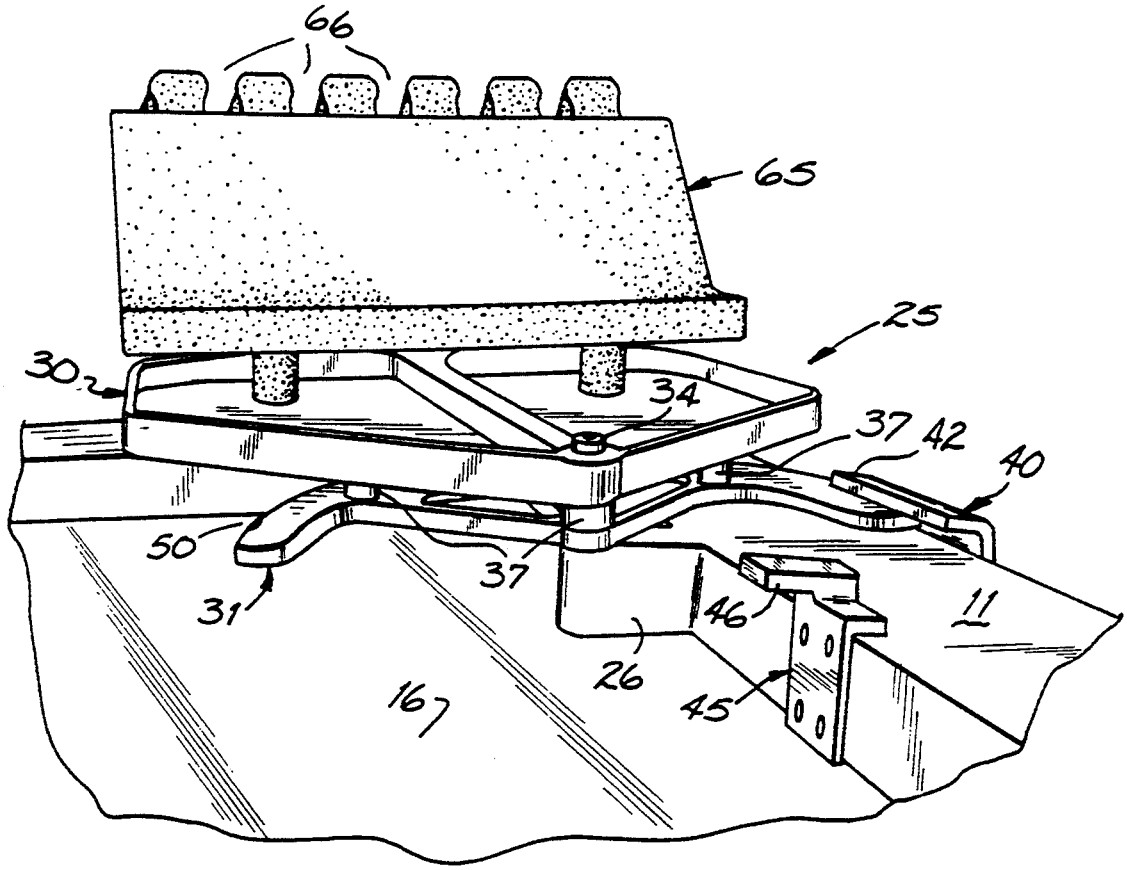
FIG. 4 is a fragmentary perspective view of the underside of the head end of the bed showing the extender.

An extender or head support plate 25 is pivotally mounted on the underside of the frame 11. The mounting structure is best shown in FIGS. 2, 3 and 4. The bed frame 11 has a boss 26 welded to it. An extender plate 30 is bolted to a mounting plate 31 by means of three bolts 32. A pivot bolt 34 is assembled through the extender plate 30 and the mounting plate 31 and projects into a threaded bore 35 in the boss 26. Bushings 37 separate the extender plate 30 from the mounting plate 31.

A C-shaped bracket 40 is fastened by a screw 41 to the bed frame 11. The lower end of the bracket 40 has a flange 42 which is spaced from the bed frame 11 and provides a space in which the perimeter of the mounting plate 31 can ride. An antifrication tab 43 is mounted on the flange 42 to eliminate any undesirable frictional contact between the mounting plate and the bracket 40. Two lateral brackets 45 are also mounted on the bed frame 11. Each has a flange 46 creating, with the bed frame 11, a space to receive the perimeter of the mounting plate 31. Bracket 40 has a vertical leg which receives a screw 48 that terminates in a ball detent 49 which is spring-loaded by a spring, not shown, so as to engage the perimeter of the mounting plate 31. The mounting plate 31 has three recesses or grooves 50 which receive the ball 49 to keep the mounting plate and extender plate 30 in position against inadvertent displacement. The detents and grooves are arranged so that regardless of the position, the mounting plate will always be engaged by a ball 49. The brackets 40 and 45, together with the pivot bolt 34, retain the extender and mounting plate on the bed frame.

The extender plate 30 has a free end 55. A U-shaped wire brace 56 is pivotally mounted by two retainers 57 to the free end of the extender plate 30. The wire brace 56 has projecting ends 58 which engage the free end 55 of the extender plate 30 when the brace is pivoted to a vertical position with respect to the extender plate. As shown in FIG. 2, the brace has a storage or inoperative position in which it lies horizontally against the surface of the extender plate 30, thus permitting the extender to be moved fully under the bed frame.

The function of the wire brace, in its operative position as shown in FIG. 1, is to retain a pillow 60, shown in phantom lines between the wire brace 56 and the mattress 61, also shown in phantom lines. Also see FIG. 5.

Figure 5:
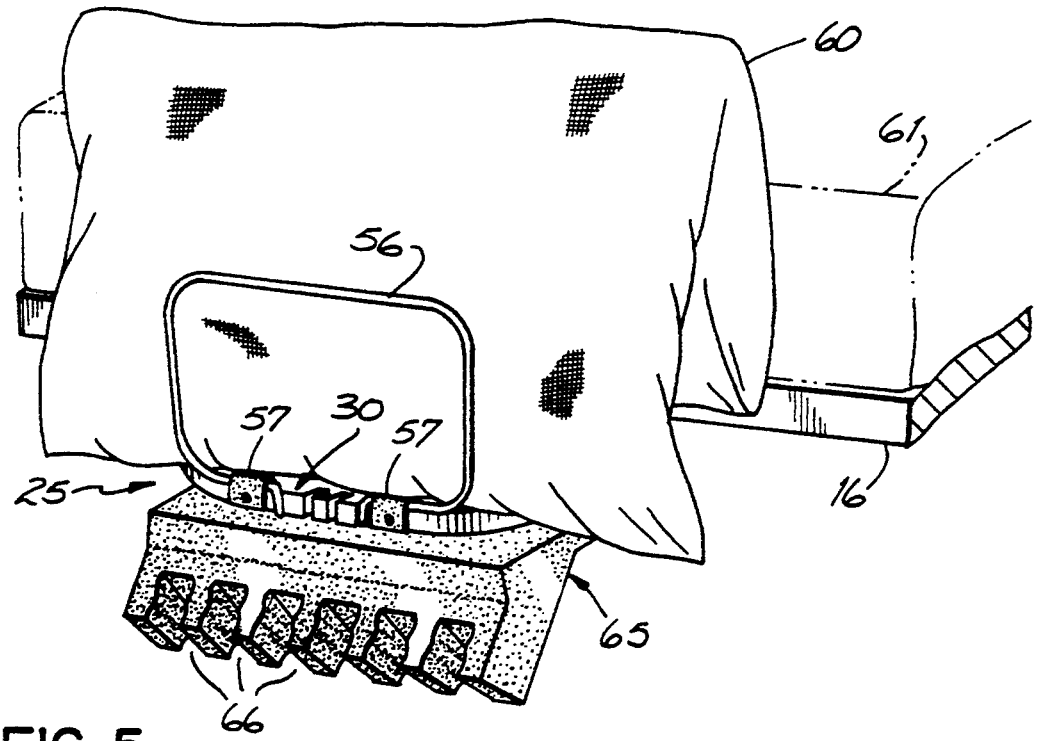
FIG. 5 is a perspective view of the head end of the bed with the extender in operational position.

In the operation of the extender plate 30, the mounting plate 31 is assembled and held in position by the brackets 40 and 45 as well as the pivot bolt 34 projecting into the threaded bore 35. It can be shifted to an inoperative position shown in phantom lines in FIG. 2 at either side of the head end of the bed. When needed, it can be shifted to the outward position shown in FIG. 2 and held there by the engagement of the ball 49 with the center groove 50 on the mounting plate 31. When in the operative position, the wire is flipped up to the vertical position and a pillow is inserted between the wire and the mattress as best shown in FIG. 5. A patient can then be shifted toward the head end of the bed to make accessible to the C-arm the abdominal and femoral areas of a patient. Such shifting facilitates other procedures as well, such as air way intubations and patient hair washing, the latter of which will be subsequently described.

Figure 6:
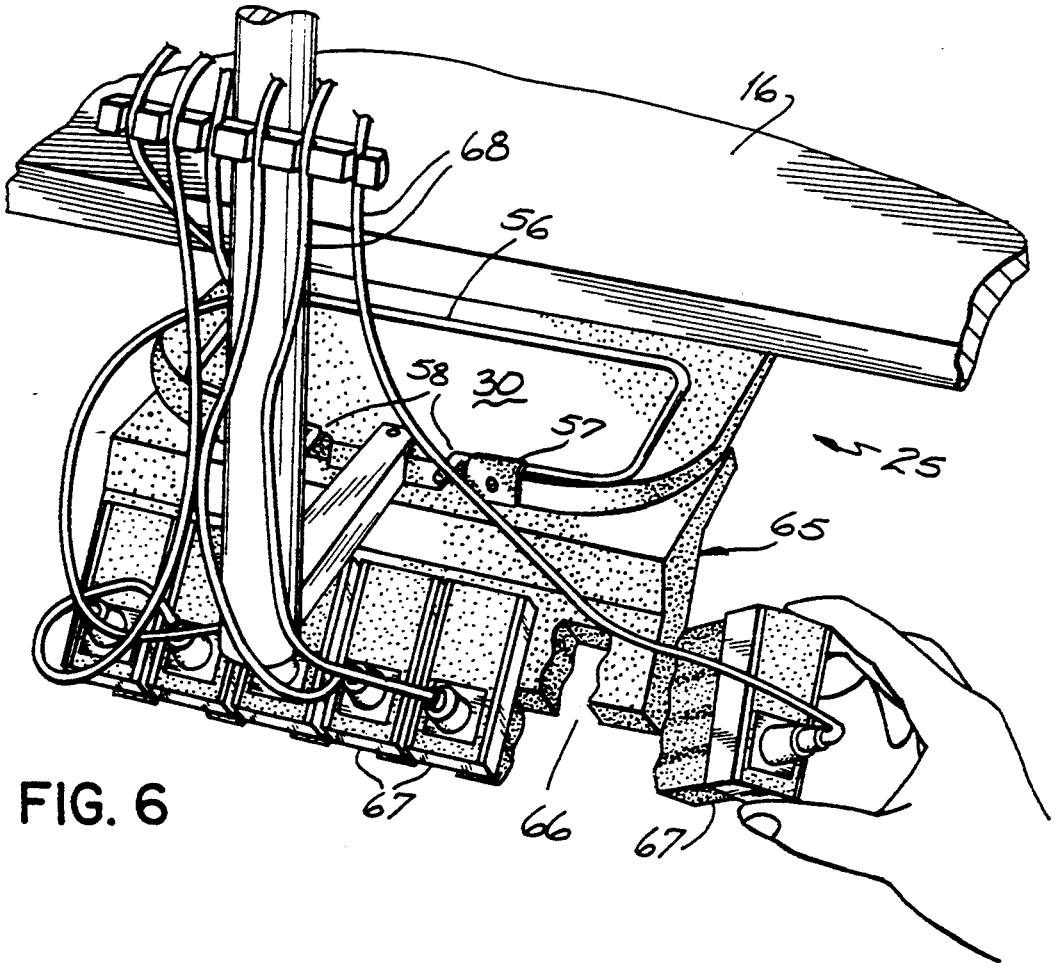
FIG. 6 is a perspective view similar to that of FIG. 5 showing the conductor organizer.
Figure 7:
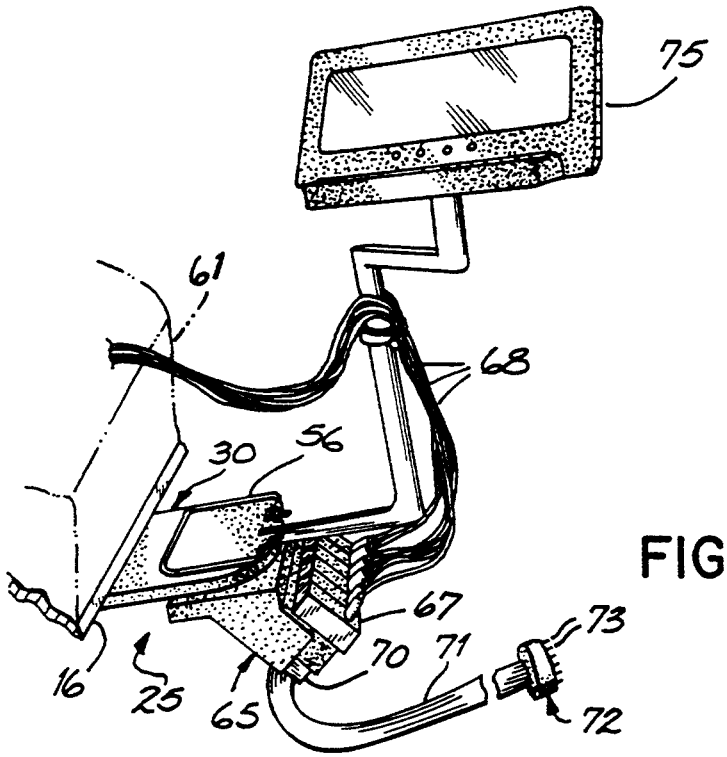
FIG. 7 is a perspective of the head end of the bed showing additional features of the conductor organizer.

As shown in FIGS. 5, 6 and 7, a mounting block 65 may be secured to the underside of the extender plate 30 by means of screws, not shown. The block 65 has six recesses 66, each of which is adapted to frictionally receive a terminal 67 from a conductor 68. Six conductors are shown in FIGS. 6 and 7. Those conductors are connected to the patient's body or to auxiliary equipment for monitoring the patient's functions.

The terminals 67 are electrically connected to a single block 70 from which a cable 71 emanates. The cable 71 has a single plug 72 with plural jacks 73 projecting from it, the jacks 73 corresponding to the six conductors connected to the bracket 65. The plug 72 is then connected to a receptacle for a monitor or series of monitors that may be mounted on a power column or on a care cart that rides along with the bed or also to a monitor which can be mounted on the bed. One such monitor is shown at 75 in FIG. 7.

Figure 8:
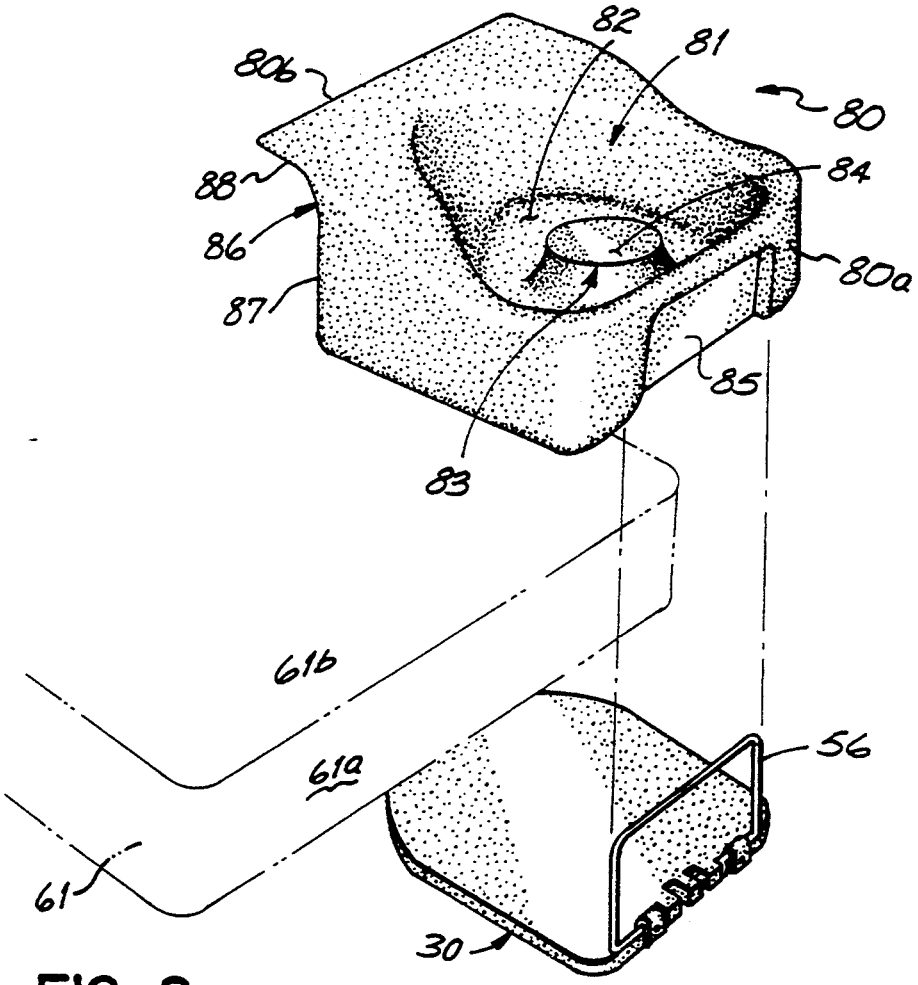
FIG. 8 is a perspective view of the head extender shown with a hair washing basin adapted to be used with the head extender.
Figure 9:
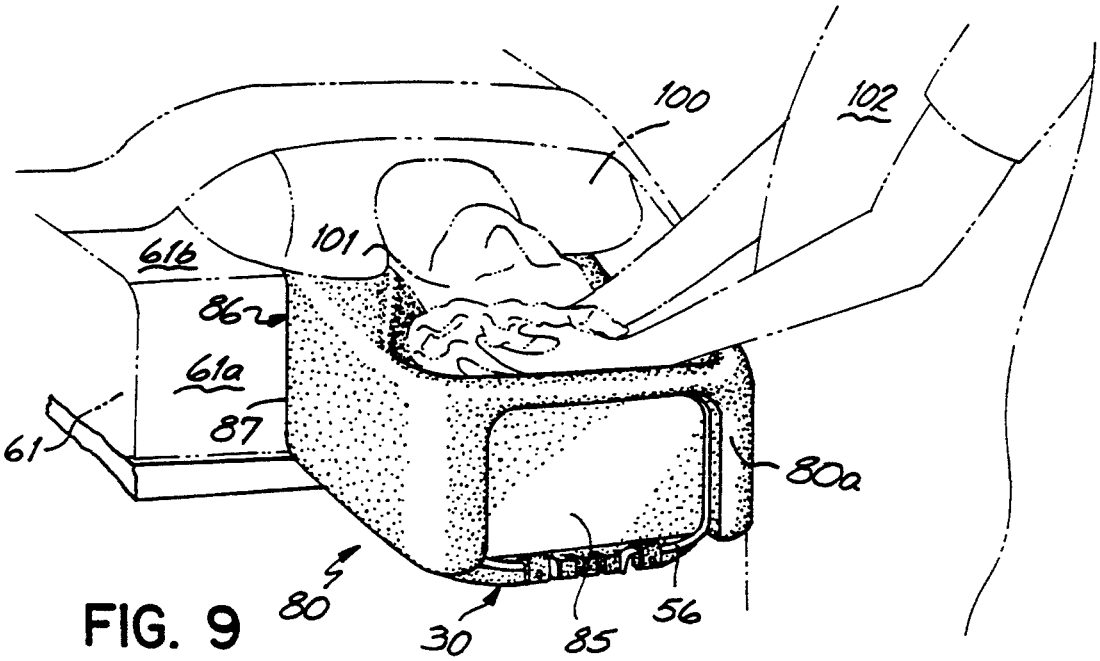
FIG. 9 is a view similar to FIG. 8 showing use of the basin in shampooing a patient's hair.

With reference to FIGS. 8 and 9, there is illustrated a basin 80 which is adapted to be used in conjunction with the hospital bed head end extender of the type disclosed herein having a head support plate 30 and U-shaped wire pillow brace 56. The basin 80 preferably takes the form of a plastic shell which includes a head receiving cavity 81 therein. Projecting upwardly from the bottom 82 of the cavity 81 is a patient head supporting pedestal 83, the top surface 84 of which serves to support a patient's head thereatop. It will be appreciated that the diameter of pedestal 83 is small in comparison to the diameter of the cavity 81 to provide ample clearance completely around the patient's head so that a care provider can readily shampoo the patient's entire head.

On the forward longitudinal end **80*a* of the basin 80 there is a recess 85 which is adapted to receive the U-shaped wire pillow brace 56 when the same is extended upwardly in its vertical orientation. On the aft end 80*b* of the basin 80 there is an inverted L-shaped lip 86 which includes a vertical leg section 87 and a horizontal foot section 88, each respectively fitting against the forward vertical 61*a* and horizontal 61*b* surfaces of the mattress 61 when installed (FIG. 9**).

After installation of basin 80 atop head support plate 30 and between wire brace 56 and vertical surface **61*a* of mattress 61, patient 100 is shifted toward the head end of the bed placing the patient's head 101 atop surface 84 of pedestal 83 of the basin 80. Care provider 102 can then readily access all areas around the patient's head 101** with his or her hands, thereby facilitating shampooing of the patient's head.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. An extender for the head end of a hospital bed having a frame comprising, a head support plate, means for pivotally mounting said plate to the head end of said frame to permit said plate to move between an operative position extending horizontally beyond said frame and a concealed position under said frame about an axis generally perpendicular to a plane defined by said head end of said bed, whereby, when in the operative position, the head end of a patient, shifted toward the head end of the bed, can be supported by said plate.

2. An extender as in claim 1 further comprising, a pillow brace mounted on said plate, means for mounting said pillow brace for movement between an operative, substantially vertical position perpendicular to said plate and an inoperative position lying against said plate.

3. An extender as in claim 1 in which said mounting means comprises, a horizontal mounting plate fixed to said extender and pivoted to said frame, said mounting plate having an arcuate rim, a plurality of grooves on said arcuate rim, at least one resilient detent mounted on said frame and a plurality of recesses in said arcuate rim to receive said detent and to hold said support plate in one of its positions.

4. The extender of claim 2 further comprising a basin adapted to be used in conjunction with said extender, said basin comprising:

a shell having a head receiving cavity therein; and means on opposed longitudinal ends of said shell for snugly fitting said shell between said pillow brace and a mattress atop said bed.

5. The extender of claim 4 further including a pedestal projecting upwardly from within said cavity for resting a patient's head thereatop while providing clearance completely around the head so that a care provider can shampoo the patient's head.

6. An extender for the head end of a hospital bed having a frame comprising, a head support plate, means for pivotally mounting said plate to the head end of said frame to permit said plate to move between an operative position extending horizontally beyond said frame and a concealed position under said frame about an axis generally perpendicular to a plane defined by a horizontal support surface of said head end of said bed, whereby, when in the operative position, the head end of a patient, shifted toward the head end of the bed, can be supported by said plate, a pillow brace mounted on said plate, means for mounting said pillow brace for movement between an operative, substantially vertical position perpendicular to said plate and an inoperative position lying against said plate;

said pillow brace comprising a U-shaped wire having two ends, said ends being pivotally mounted in the edge of said plate to permit said brace to swing between vertical and horizontal positions.

7. An extender for the head end of a hospital bed having a frame comprising, a head support plate, means for pivotally mounting said plate to the head end of said frame to permit said plate to move between an operative position extending horizontally beyond said frame and a concealed position under said frame about an axis generally perpendicular to a plane defined by a horizontal support surface of said head end of said bed, whereby, when in the operative position, the head end of a patient, shifted toward the head end of the bed, can be supported by said plate, a block mounted on said plate, said block having a plurality of receptacles for receiving a plurality of electrical terminals emanating from conductors forming monitoring connections to a patient, whereby said terminals can be conveniently organized for connection to a single cable multiple conductor connected to recording and/or display equipment.

8. An extender for the head end of a hospital bed having a frame comprising, a head support plate, means for mounting said plate to the head end of said frame to permit said plate to move between an operative position extending horizontally beyond said frame and a concealed position under said frame, whereby, when in the operative position, the head of a patient, shifted toward the head end of the bed, can be supported by said plate, a pillow brace mounted on said plate, means for mounting said pillow brace for movement between an operative, substantially vertical position perpendicular to said plate and an inoperative position lying against said plate, and a basin adapted to be used in conjunction with said extender, said basin comprising:

a shell having a head receiving cavity therein; and means on opposed longitudinal ends of said shell for snugly fitting said shell between said pillow brace and a mattress atop said bed comprising, on one end, a recess for receiving said pillow brace, and on the other end an inverted L-shaped lip for fitting against vertical and horizontal surfaces of said mattress.

* * * * *

UNITED STATES PATENT AND TRADEMARK OFFICE

CERTIFICATE OF CORRECTION

PATENT NO. : 5,335,384

DATED : August 9, 1994

INVENTOR(S) : L. Dale Foster, et al

It is certified that error appears in the above-identified patent and that said Letters Patent is hereby corrected as shown below:

Column 4, line 48, after "plate" delete "to" and insert -- at a position under --.

Column 4, line 50, after "position" delete "extending" and insert -- wherein said plate extends --.

Column 4, line 51, after "and" delete "a concealed" and insert -- an inoperative --.

Column 4, line 51, after "position" insert -- wherein said plate is located --.

Column 4, line 53, after "by" insert -- a horizontal support surface of --.

Signed and Sealed this

Eighteenth Day of July, 1995

*Attest:*

Bruce Lehman

BRUCE LEHMAN

*Attesting Officer*

*Commissioner of Patents and Trademarks*